US011346167B2

(12) United States Patent
Carnes, Sr.

(10) Patent No.: US 11,346,167 B2
(45) Date of Patent: May 31, 2022

(54) DRILLSTRING PRESSURE RELIEF

(71) Applicant: William Wesley Carnes, Sr., Carthage, TX (US)

(72) Inventor: William Wesley Carnes, Sr., Carthage, TX (US)

( * ) Notice: Subject to any disclaimer, the term of this patent is extended or adjusted under 35 U.S.C. 154(b) by 0 days.

(21) Appl. No.: 17/399,836

(22) Filed: Aug. 11, 2021

(65) Prior Publication Data

US 2021/0372210 A1 Dec. 2, 2021

(51) Int. Cl.
*E21B 21/08* (2006.01)
*E21B 21/10* (2006.01)

(52) U.S. Cl.
CPC ..... *E21B 21/08* (2013.01); *E21B 21/106* (2013.01)

(58) Field of Classification Search
CPC ..... E21B 21/08; E21B 21/106
See application file for complete search history.

(56) References Cited

U.S. PATENT DOCUMENTS 4,681,133 A * 7/1987 Weston ..... F16K 11/0873 137/315.18
5,355,960 A 10/1994 Schultz
7,107,875 B2 9/2006 Haugen
8,413,677 B1 4/2013 Coffman
9,057,235 B2 6/2015 Blue
10,822,908 B2 11/2020 Coffey
2005/0061514 A1* 3/2005 Hopper ..... B01D 17/00 166/357
2008/0078586 A1 4/2008 Tettleton
2019/0338613 A1* 11/2019 Kibler ..... E21B 33/03

FOREIGN PATENT DOCUMENTS

CN 211008522 7/2020

* cited by examiner

*Primary Examiner* — Dany E Akakpo
(74) *Attorney, Agent, or Firm* — Laurie A. Schlichter, PLLC; Laurie A. Schlichter

(57) ABSTRACT

Described herein is a system for relieving pressure in a drillstring on a drilling rig. The system includes a remote switch which moves from a closed-valve position to an open-valve position. The system also includes a valve actuator which moves from a first valve actuator position to a second valve actuator position when the remote switch moves from the closed-valve position to the open-valve position. The system further includes a valve to route a drilling fluid from the drillstring to a flowline via a bleed-off line when the valve moves from a closed position to an open position as the valve actuator moves from the first valve actuator position to the second valve actuator position.

20 Claims, 4 Drawing Sheets

100

300

DRILLSTRING PRESSURE RELIEF

TECHNICAL FIELD

The present disclosure relates generally to techniques for relieving the pressure in a drillstring on a drilling rig. More specifically, the present techniques relate to relieving the pressure in a drillstring using a valve that is actuated remotely.

BACKGROUND ART

A drilling fluid in a drillstring is under pressure when drilling for hydrocarbons. Relief of this pressure is necessary before the drillstring can be lengthened by adding a section of drillpipe. To relieve the pressure in the drillstring, members of the drilling crew have to manually open a valve that routes the drilling fluid to a flowline via a bleed-off line. The pressure in the drillstring has to dissipate to a certain point before the valve can be opened. Dissipation occurs slowly which increases the amount of time needed to add a section of drillpipe to the drillstring.

BRIEF DESCRIPTION OF THE DRAWINGS

The same numbers are used throughout the disclosure and the figures to reference like features. Numbers in the 100 series refer to features originally found in FIG. 1; numbers in the 200 series refer to features originally found in FIG. 2; and so on.

DESCRIPTION OF THE EMBODIMENTS

A drilling fluid serves a number of functions that are essential to success when drilling for crude oil or natural gas. The various functions are accomplished as the drilling fluid moves down the drillstring, out the drill bit, and up the annulus. High pressure is maintained in the drillstring to force the drilling fluid through the jets in the drill bit and up the annulus to the surface. The pressure in the drillstring has to be relieved before the drillstring can be lengthened by adding a section of drillpipe. More specifically, the pressure in the drillstring has to decrease to atmospheric pressure before the rig crew can unscrew a threaded connection between two sections of the drillstring. The opening created in the drillstring makes it possible to add another section of drillpipe.

Relief of the drillstring pressure occurs when a drilling fluid delivery system, i.e., a mud pump or a gas compressor, is stopped and the drilling fluid reverses direction. The drilling fluid moves up the drillstring, through the rotary hose, and down a standpipe on the drilling rig. A valve is manually opened to divert the drilling fluid to a flowline via a bleed-off line. The pressure in the drillstring has to dissipate until the manual valve can be turned. Dissipation occurs slowly because of the length of the drillstring. In addition, certain components of the drillstring (e.g., float valves and downhole pumps) can further impede dissipation. The slow dissipation of the drillstring pressure increases the amount of time needed to add a section of drillpipe to the drillstring. The drilling of the wellbore takes more time given that dissipation of the drillstring pressure has to occur every time a section of drillpipe is added. As a result, the cost to drill the wellbore increases. Less time-intensive and more cost-effective techniques for relieving drillstring pressure are needed.

The present disclosure describes techniques for relieving pressure in a drillstring using a remote switch and a valve actuator. For example, the remote switch may move from a closed-valve position to an open-valve position. The valve actuator may move from a first valve actuator position to a second valve actuator position when the remote switch moves from the closed-valve position to the open-valve position. A valve may route a drilling fluid from the drillstring to a flowline via a bleed-off line when the valve moves from a closed position to an open position as the valve actuator moves from the first valve actuator position to the second valve actuator position. Various examples of the present techniques are described below with reference to the accompanying figures.

Figure 1:
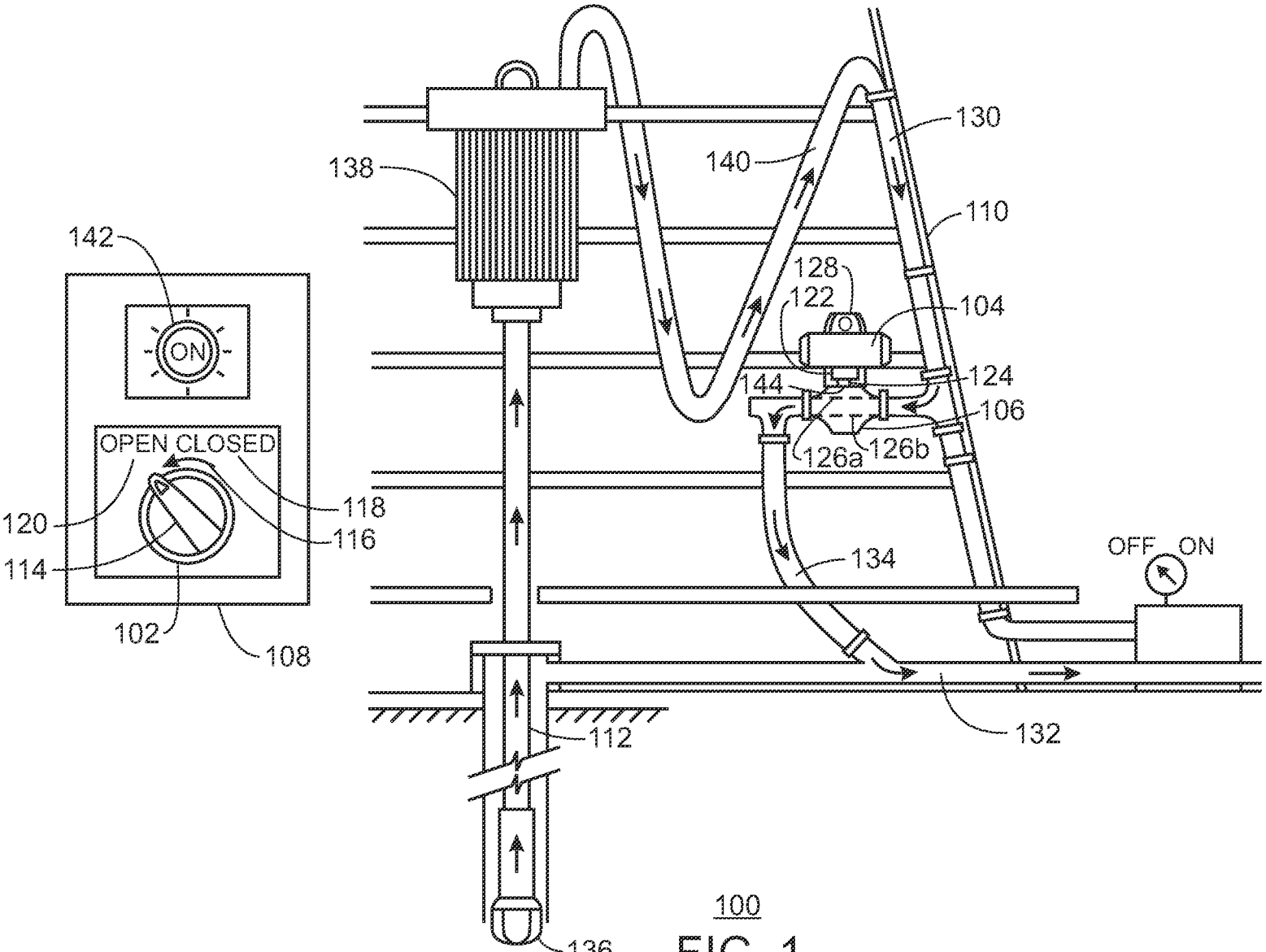
FIG. 1 is an illustration of a system for relieving drillstring pressure when a valve is in an open position.

FIG. 1 is an illustration of a system for relieving drillstring pressure when a valve is in an open position. The components of the system 100 may include a remote switch 102, a valve actuator 104, and a valve 106. The remote switch 102 may be located in a console 108 in the "doghouse," a small building adjacent to the drilling rig 110. The supervisor of the rig crew, known as the "driller," controls drilling operations from the doghouse. The driller uses the remote switch 102 to open the valve 106 prior to the addition of a length of drillpipe to the drillstring 112.

The valve 106 may be opened by rotating a handle 114 on the remote switch 102 in the direction indicated by arrow 116. Accordingly, the remote switch 102 may move from a closed-valve position 118 to an open-valve position 120. The remote switch 102 may remain in the open-valve position 120 until the handle 114 is rotated in the direction opposite to the direction indicated by arrow 116.

When the remote switch 102 is in the open-valve position 120, an internal mechanism of the valve actuator 104 may move a valve actuator stem. A stem connector 122 may join the valve actuator stem to a valve stem 124 of the valve 106. Hence, movement of the valve actuator stem may cause the valve stem 124 to move. The valve 106 may move with the valve stem 124. In particular, the valve 106 may move from the fully closed position to the fully open position.

In the embodiment shown in FIG. 1, the valve 106 is a plug valve which is operated by rotating it a quarter turn. Hence, the valve 106 is coupled to the valve actuator 104 that causes the valve actuator stem, stem connector 122, and valve stem 124 to rotate. As the valve stem 124 rotates, the valve 106 rotates as well. After rotating 90°, the valve 106 has moved from the fully closed position to the fully open position. In the fully open position, the passage through the plug and the inlet and outlet ports of the plug valve are aligned as indicated by the dashed lines 126*a*, 126*b* in FIG. 1. A valve position sensor 128 is reading "0" to confirm that the valve 106 is open.

The valve 106 may be located in a section of pipe that is lateral to a standpipe 130. When open, the valve 106 may connect the standpipe 130 to a flowline 132 via a bleed-off line 134. This connection may complete a path from the drillstring 112 to the flowline 132. The high pressure in the drillstring 112 may move a drilling fluid along this path. In particular, the drilling fluid may progress from a drill bit 136 through the drillstring 112 to a top drive 138, from the top drive 138 through a rotary hose 140 to the standpipe 130, and from the standpipe 130 through the valve 106 and the bleed-off line 134 to the flowline 132. In this way, the pressure in the drillstring 112 is relieved so that a length of drillpipe may be added to the drillstring 112.

The relief of the pressure in the drillstring 112 may be initiated when the remote switch 102 moves from the closed-valve position 118 to the open-valve position 120. In the embodiment shown in FIG. 1, the remote switch 102 is a rotary switch. Other types of mechanical switches may be used. Any type of switch may be utilized as long as it can be wired to make or break the circuit supplying an electrical signal to the valve actuator 104. For example, the rotary switch shown in FIG. 1 may be a single pole single throw (SPST) switch. In another embodiment, a single pole double throw (SPDT) switch may be wired to mimic the SPST switch by connecting only two of the three contacts on the SPDT switch. In yet another embodiment, if properly wired, a double pole single throw (DPST) switch or a double pole double throw (DPDT) switch may be used to alternately complete and interrupt the circuit that supplies the electrical signal to the valve actuator 104.

The SPST, SPDT, DPST, and DPDT switches may be operated in a number of ways. In the embodiment shown in FIG. 1, the rotary switch is operated by rotating the handle 114 from the closed-valve position 118 to the open-valve position 120. Other types of switches move in different ways. For example, a toggle switch has a lever that is moved up and down; a rocker switch rocks back and forth so that one end is raised while the other end is depressed; a slider switch has a bar handle that moves linearly; a push-button switch has a button that is pushed and then is returned to its default position by a spring; and a push-pull switch has a handle that is pushed down and pulled up.

Furthermore, switches may be characterized by their state. They are either latched or momentary. In the embodiment shown in FIG. 1, the rotary switch is a latched switch. Once moved to the open-valve position 120, the switch will remain in that position until moved to the closed-valve position 118. In contrast, if the rotary switch were a momentary switch, it would only remain in the open-valve position 120 as long as it is held in that position by the driller. Either type of switch may be used in the system 100 for relieving pressure in the drillstring 112.

The console 108 containing the remote switch 102 may also house a valve position indicator light 142. In the embodiment shown in FIG. 1, the valve position indicator light 142 is turned on to signify that the valve 106 is open. In another embodiment, the valve position indicator light 142 is turned off when the valve 106 is in the open position. In yet another embodiment, two lights are used to indicate that the valve 106 is open. One light is labeled "Open" and the other light is labeled "Closed." The light designated "Open" is turned on and the light designated "Closed" is turned off when the valve 106 is in the open position.

The remote switch 102 may open or close the valve 106 by causing the valve actuator 104 to move. The valve actuator 104 may be mounted on the bonnet 144 of the valve 106. The valve stem 124 may pass through the bonnet 144 and is joined to the valve actuator stem by a stem connector 122. As a result, the valve actuator 104 is coupled to the valve's closure element (e.g., plug, ball, gate, etc.). Hence, movement of the valve actuator 104 causes the closure element to move and open or close the valve 106.

Valve actuators open and close a valve by converting an energy source into mechanical motion. Supply of the energy source is affected by movement of the remote switch. As the remote switch moves, it either completes or interrupts a circuit that sends an electrical signal to the valve actuator. When the circuit is completed, the valve actuator receives the electrical signal and the supply of the energy source is turned on. The energy source flows to the valve actuator. When the circuit is interrupted, the valve actuator fails to receive the electrical signal and the supply of the energy source is turned off. The energy source ceases to flow to the valve actuator. Depending upon the design of the valve actuator, the flow or the cessation of the flow of the energy source provides the force that causes the valve actuator to move the valve.

Valve actuators are classified by the type of energy source that is converted into mechanical motion. The energy source may be pneumatic pressure, hydraulic pressure, or electric current. Pneumatic valve actuators convert pneumatic pressure into mechanical motion. The pneumatic pressure is typically provided by compressed air, but other compressed gases (e.g., nitrogen or natural gas) may be used.

In an embodiment of the present techniques, the valve actuator is a pneumatic valve actuator. There are two types of pneumatic valve actuators: diaphragm valve actuators and piston valve actuators. In an example, the pneumatic valve actuator is a diaphragm valve actuator. A diaphragm valve actuator has a diaphragm that seals a pressure chamber. Pneumatic pressure is applied to the diaphragm causing it to move and open or close the actuated valve. There are two types of diaphragm valve actuators: direct acting and reverse acting.

In an implementation, pneumatic pressure is applied to the top of the diaphragm in a direct-acting valve actuator. The pneumatic pressure pushes down on the diaphragm. As the diaphragm moves downward, it pushes down on the valve stem causing the valve to close. This action compresses a spring in the valve actuator. When the pneumatic pressure is vented, the compressed spring lengthens pushing the diaphragm upward which raises the valve stem and opens the valve. This type of valve is designated an air-to-close, fail-open (ATC-FO) valve.

A direct-acting valve actuator may be used in the system 100 shown in FIG. 1. The remote switch 102 moves from the closed-valve position 118 to the open-valve position 120. In the open-valve position 120, the remote switch 102 interrupts the circuit that supplies an electrical signal to the valve actuator 104. The supply of pressurized air to the valve actuator 104 shuts off when the electrical signal is lost. The pressure in the valve actuator 104 cannot be maintained and the compressed spring lengthens forcing the diaphragm to move upward which unseats the closure element and opens the valve 106.

In another implementation, pneumatic pressure is applied to the bottom of the diaphragm in a reverse-acting valve actuator. The pneumatic pressure pushes up on the diaphragm. As the diaphragm moves upward, it pulls up the valve stem causing the valve to open. This action stretches the spring in the actuator. When the pneumatic pressure is vented, the stretched spring shortens and pulls the diaphragm downward which lowers the valve stem and closes the valve. This type of valve is designated an air-to-open, fail-close (ATO-FC) valve.

A reverse-acting diaphragm valve actuator may be used in the system 100 shown in FIG. 1. The remote switch 102 moves from the closed-valve position 118 to the open-valve position 120. In the open-valve position 120, the remote switch 102 completes the circuit that supplies an electrical signal to the valve actuator 104. Pressurized air is supplied to the valve actuator 104 when the electrical signal is received. The pressure in the valve actuator 104 increases and pushes up on the diaphragm. The valve stem 124 is pulled up as the diaphragm moves upward and the valve 106 opens.

In another example, the pneumatic valve actuator is a piston valve actuator. In a piston valve actuator, a piston moves in a cylindrical chamber. Air is supplied to one side of the piston causing the piston to move. The piston is coupled to the valve stem of the actuated valve. The valve stem moves with the piston causing the valve to open or close. There are two types of piston valve actuators: single acting and double acting.

In an implementation, pressurized air pushes the piston in one direction and a spring pushes the piston in the opposite direction in a single-acting valve actuator. Single-acting valve actuators have a fail-safe position. Accordingly, the spring forces the single-acting valve actuator to move to this position when electric power or air supply is lost. Valve actuators of this type are designated "fail open" (FO) or "fail close" (FC).

For example, a fail-open valve actuator requires a supply of air to close the actuated valve. Hence, when there is an interruption of electric power or air supply, the spring forces the valve actuator to move in the direction that causes the valve to open.

A fail-open valve actuator may be used in the system 100 shown in FIG. 1. The remote switch 102 moves from the closed-valve position 118 to the open-valve position 120. In the open-valve position 120, the remote switch 102 interrupts the circuit that supplies an electrical signal to the valve actuator 104. The supply of pressurized air to the valve actuator 104 shuts off when the electrical signal is lost. The pressure in the valve actuator 104 decreases and the spring forces the piston to move in the direction that opens the valve 106.

In contrast, a fail-close valve actuator requires a supply of air to open the actuated valve. Hence, when there is an interruption of electric power or air supply, the spring forces the valve actuator to move in the direction that causes the valve to close.

A fail-close valve actuator may be used in the system 100 shown in FIG. 1. The remote switch 102 moves from the closed-valve position 118 to the open-valve position 120. In the open-valve position 120, the remote switch 102 completes the circuit that supplies an electrical signal to the valve actuator 104. Pressurized air is supplied to the valve actuator 104 when the valve actuator 104 receives the electrical signal. The pressure in the valve actuator 104 increases and forces the piston to move in the direction that opens the valve 106.

In another implementation, the piston valve actuator is a double-acting valve actuator. Double-acting valve actuators do not have a spring. Instead, they have a port at each end and the piston is moved by alternating the port that receives pressurized air. For the sake of explanation, the port at one end is designated the first port and the port at the other end is designated the second port. When the first port is supplied with pressurized air, the piston moves in the direction that opens the actuated valve and air exits the second port. Conversely, when the second port is supplied with pressurized air, the piston moves in the direction that closes the valve and air exits the first port.

Because they lack a spring, double-acting valve actuators do not have a known fail-safe position. Instead, double-acting valve actuators maintain or move to their last position (open or closed) when electric power or air supply is interrupted. If the double-acting valve actuator is in the open position, it will remain in this position when the motive force is lost. The double-acting valve actuator will return to the open position if it is moving from the open position toward the closed position when loss of the motive force occurs. If the double-acting valve actuator is in the closed position, it will remain in this position when the motive force is lost. The double-acting valve actuator will return to the closed position if it is moving from the closed position toward the open position when loss of the motive force occurs.

A double-acting valve actuator may be used in the system 100 shown in FIG. 1. The remote switch 102 moves from the closed-valve position 118 to the open-valve position 120. In the open-valve position 120, the remote switch 102 completes the circuit that supplies an electrical signal to the valve actuator 104. Pressurized air is supplied to the first port of the valve actuator 104 when the valve actuator 104 receives the electrical signal. The piston moves in the direction that opens the valve 106 while air exits the second port.

To close the valve 106, the remote switch 102 moves from the open-valve position 120 to the closed-valve position 118. In the closed-valve position 118, the remote switch 102 interrupts the circuit that supplies an electrical signal to the valve actuator 104. Pressurized air is supplied to the second port of the valve actuator 104 when the valve actuator 104 fails to receive the electrical signal. The piston moves in the direction that closes the valve 106 while air exits the first port.

Alternatively, the remote switch 102 moves from the closed-valve position 118 to the open-valve position 120 and the circuit that supplies an electrical signal to the valve actuator 104 is interrupted. Pressurized air is supplied to the first port of the valve actuator 104 when the valve actuator 104 fails to receive the electrical signal. The piston moves in the direction that opens the valve 106 while air exits the second port. To close the valve 106, the remote switch 102 moves from the open-valve position 120 to the closed-valve position 118 and the remote switch 102 completes the circuit that supplies an electrical signal to the valve actuator 104. Pressurized air is supplied to the second port of the valve actuator 104 when the valve actuator 104 receives the electrical signal. The piston moves in the direction that closes the valve 106 while air exits the first port.

In another embodiment of the present techniques, the valve actuator is a hydraulic valve actuator. Hydraulic valve actuators convert hydraulic pressure into mechanical motion. The hydraulic pressure is provided by hydraulic fluid (e.g., water or oil). Hydraulic valve actuators use a piston to open and close the actuated valve. Hydraulic fluid is supplied to one side of the piston causing the valve to open; hydraulic fluid is supplied to the other side of the piston causing the valve to close. The operation of hydraulic valve actuators is very similar to that of pneumatic valve actuators having a piston. Hence, the description of the operation of piston valve actuators provided above applies to hydraulic valve actuators as well. However, the mechanical components of hydraulic valve actuators are moved by pressurized hydraulic fluid, not compressed gas. A hydraulic valve actuator may be used in the system 100 shown in FIG. 1.

In yet another embodiment of the present techniques, the valve actuator is an electric valve actuator. Electric valve actuators convert electric current into mechanical motion. They use an electric motor to open and close the actuated valve. The electric motor is coupled to the valve actuator shaft via a gear reduction drive. This type of gear drive reduces the output speed of the electric motor and thereby increases the torque available to move the valve stem connected to the valve actuator shaft. An electric valve actuator may be used in the system 100 shown in FIG. 1.

Electric valve actuators operate by reversing the direction of rotation of the electric motor. A valve is driven from the closed to open position when the electric motor rotates in one direction and the valve is driven from the open to closed position when the electric motor rotates in the opposite direction. An on-off-on switch determines the direction of rotation. The switch is moved from the intermediate "off" position to one of the "on" positions which completes a circuit causing the electric motor to rotate in one direction. The switch is moved from the "off" position to the other "on" position which interrupts the circuit causing the electric motor to rotate in the opposite direction.

In an example, limit switches may be used to stop the electric motor when the valve reaches the fully open or fully closed position. Limit switches are electromechanical devices that are activated by movement of the valve actuator shaft. As the shaft moves, a cam fixed to the shaft strikes a set of electrical contacts that are part of the limit switch. When the cam and the electrical contacts touch, the limit switch either makes or breaks the circuit that controls the electric motor and the motor stops.

For instance, one of the "on" positions of the on-off-on switch is the open-valve position and the other "on" position is the closed-valve position. When the on-off-on switch is moved from the "off" position to the open-valve position, the circuit is completed causing the electric motor to rotate in the direction that moves the valve from the fully closed position toward the fully open position. A spring in the on-off-on switch returns the switch to the "off" position. When the valve reaches the fully open position, a cam on the valve actuator shaft strikes a first set of electrical contacts causing a first limit switch to interrupt the circuit. The electric motor stops and remains stopped until the on-off-on switch is moved from the "off" position to the closed-valve position. The movement of the on-off-on switch interrupts the circuit causing the electric motor to rotate in the opposite direction. The valve is moved from the fully open position toward the fully closed position. The spring in the on-off-on switch returns the switch to the "off" position. When the valve reaches the fully closed position, the cam on the valve actuator shaft strikes a second set of electrical contacts causing a second limit switch to complete the circuit and stop the electric motor. Limit switches may be used in the system 100 shown in FIG. 1 if the valve actuator 104 is an electric valve actuator.

In another example, proximity sensors may be used to stop the electric motor in an electric valve actuator. However, unlike limit switches, proximity sensors do not have to physically interact with the objects they detect. Proximity sensors may be inductive, capacitive, or magnetic.

In an implementation, inductive proximity sensors have a coil inside of them. When current is applied, the coil generates an electromagnetic field. When the actuated valve is in the fully open or fully closed position, a metallic "target" on the valve actuator shaft enters the electromagnetic field and causes the strength of the field to dampen. This dampening changes the output state of the sensor. If the sensor has a normally open configuration, its output changes from an "off" signal to an "on" signal. If the sensor is normally closed, its output changes from an "on" signal to an "off" signal. The change in the output signal causes the electric motor to stop. Inductive proximity sensors may be used in the system 100 shown in FIG. 1 if the valve actuator 104 is an electric valve actuator.

In another implementation, capacitive proximity sensors have two conduction plates (at different potentials) housed in the sensing head. The two plates function like an open capacitor; there is little capacitance between them. When the actuated valve is in the fully open or fully closed position, a target on the valve actuator shaft is in the sensing zone and the capacitance of the two plates increases. The result is the creation of an output signal which causes the electric motor to stop. Capacitive proximity sensors may be used in the system 100 shown in FIG. 1 if the valve actuator 104 is an electric valve actuator.

In yet another implementation, magnetic proximity sensors are activated by the presence of a magnetic target. The magnetic field created by the target triggers a change in the output state of the sensor ("off" to "on" or vice versa) when the target is in the detection range of the sensor. When a magnetic target on a valve actuator shaft is aligned with a magnetic proximity sensor, the actuated valve is either in the fully open or fully closed position. The output state of the sensor changes causing the electric motor to stop. As a result, the valve remains in the fully open or fully closed position. Magnetic proximity sensors may be used in the system 100 shown in FIG. 1 if the valve actuator 104 is an electric valve actuator.

There are several types of magnetic proximity sensors that may be used to stop the electric motor in an electric valve actuator. Their operation is based upon the same underlying principle; the target's magnetic field triggers a change in the output state of the sensor. However, they react differently to the target's magnetic field.

The first type of magnetic proximity sensor is a variable reluctance (VR) proximity sensor. VR proximity sensors contain a permanent magnet surrounded by a wire coil. When a ferromagnetic target on the valve actuator shaft is aligned with a VR proximity sensor, the actuated valve is either in the fully open or fully closed position and changing magnetic flux induces a current in the coil. As a result, an analog voltage signal is generated. This voltage signal is converted to a digital signal which can have only two values, "zero" and "one" (or "false" and "true"). When the ferromagnetic target is aligned with the sensor, the value of the digital signal changes which causes the electric motor to stop. VR proximity sensors may be used in the system 100 shown in FIG. 1 if the valve actuator 104 is an electric valve actuator.

The second type of magnetic proximity sensor is an anisotropic magnetoresistive (AMR) proximity sensor. AMR proximity sensors include a circuit that contains a Wheatstone bridge for measuring the resistance of the circuit. The magnetic target creates an axial or radial magnetic field which is necessary for the sensor to function properly. When the target on the valve actuator shaft is aligned with the AMR proximity sensor, the actuated valve is either in the fully open or fully closed position. The strength of the magnetic field around the sensor increases causing the resistance of the circuit to decrease. As the resistance decreases, the voltage gradient across the circuit increases. Once the voltage gradient is greater than the switching threshold, the sensor output state changes from "off" to "on" which causes the electric motor to stop. AMR proximity sensors may be used in the system 100 shown in FIG. 1 if the valve actuator 104 is an electric valve actuator.

The third type of magnetic proximity sensor is a giant magnetoresistive (GMR) proximity sensor. A GMR proximity sensor is similar to an AMR proximity sensor. Like the AMR sensor, the GMR sensor includes a circuit containing a Wheatstone bridge and the target creates an axial or radial magnetic field. Unlike the AMR sensor, the GMR sensor is composed of alternating magnetic and non-magnetic conductive layers. When the target on the valve actuator shaft is aligned with the GMR proximity sensor, the actuated valve is either in the fully open or fully closed position. The strength of the magnetic field around the sensor increases causing the resistance of the circuit to decrease. As the resistance decreases, the voltage gradient across the circuit increases. Once the voltage gradient is greater than the switching threshold, the sensor output state changes from "off" to "on" which causes the electric motor to stop. GMR proximity sensors may be used in the system 100 shown in FIG. 1 if the valve actuator 104 is an electric valve actuator.

The fourth type of magnetic proximity sensor is a Hall effect proximity sensor. A Hall effect proximity sensor includes a circuit containing a semiconductor. The semiconductor has current continuously flowing through it. When the target on the valve actuator shaft is aligned with the Hall effect proximity sensor, the actuated valve is either in the fully open or fully closed position. The magnetic field created by the target is radial to the current flow. As a result, the electrons in the current separate and flow to opposite sides of the semiconductor. More electrons move to one side than the other which creates a voltage gradient across the circuit. The voltage gradient increases until it is greater than the switching threshold and the sensor output state changes from "off" to "on" which causes the electric motor to stop. Hall effect proximity sensors may be used in the system 100 shown in FIG. 1 if the valve actuator 104 is an electric valve actuator.

The fifth type of magnetic proximity sensor is a reed switch proximity sensor. This type of proximity sensor contains a reed switch which is composed of a pair of ferromagnetic reeds enclosed in a sealed glass tube. In the absence of a magnetic field, the reeds are separated and the sensor output state is "off." When the target on the valve actuator shaft is aligned with the reed switch proximity sensor, the actuated valve is either in the fully open or fully closed position. The magnetic field created by the target is parallel to the reed switch and causes the two reeds to move toward each other. The two reeds contact each other and the output state of the sensor changes from "off" to "on" which causes the electric motor to stop. Reed switch proximity sensors may be used in the system 100 shown in FIG. 1 if the valve actuator 104 is an electric valve actuator.

Electric valve actuators require an uninterrupted source of power to operate. Fail-safe electric valve actuators have a mechanism that stores energy to drive the actuated valve to a "safe" position when a power loss occurs. There are three types of fail-safe mechanisms: spring return, capacitor return, and back-up battery.

In an example, a spring-return mechanism relies on mechanical energy stored by the spring to move the valve to its fail-safe position when an electric power outage occurs. When electric power is available, the electric actuator moves the actuated valve from the fully closed position to the fully open position and vice versa while simultaneously compressing a spring. When electric power is interrupted, the potential energy stored in the spring is released causing the electric actuator to move the valve to its fail-safe position. If the fail-safe position is "open," the spring drives the valve to the fully open position. In contrast, if the fail-safe position is "closed," the spring drives the valve to the fully closed position. If the valve actuator 104 shown in FIG. 1 is an electric valve actuator, a spring-return mechanism may drive the valve 106 to its fail-safe position when loss of electricity occurs.

In another example, a capacitor-return mechanism relies on electric energy stored by the capacitor to move the valve to its fail-safe position when an electric power loss occurs. When electric power is available, the capacitor stores electric energy. When electric power is interrupted, the stored electric energy is released causing the electric actuator to move the valve to its fail-safe position. If the fail-safe position is "open," the electric actuator drives the valve to the fully open position. In contrast, if the fail-safe position is "closed," the electric actuator drives the valve to the fully closed position. If the valve actuator 104 shown in FIG. 1 is an electric valve actuator, a capacitor-return mechanism may drive the valve 106 to its fail-safe position when loss of electricity occurs.

In yet another example, a back-up battery may be used instead of spring-return and capacitor-return mechanisms. Back-up batteries may be housed inside the same enclosure as the electric actuator or in a separate enclosure external to the electric actuator. A back-up battery provides an alternative power source to move a valve to its fail-safe position. When electric power is available, the back-up battery is charged using a built-in trickle charger. When loss of electric power occurs, energy stored in the back-up battery runs the electric actuator which moves the valve to its fail-safe position. Like spring-return and capacitor-return electric actuators, the battery-powered actuator drives a valve to the fully open position or fully closed position depending upon the valve's fail-safe position. However, unlike spring-return and capacitor-return electric actuators, a battery-powered actuator may drive a "fail-last" valve to its last position when an electric power outage occurs. The battery-powered actuator will return the valve to the fully open position if the valve is moving from the fully open position toward the fully closed position when electricity is lost. Likewise, the battery-powered actuator will return the valve to the fully closed position if the valve is moving from the fully closed position toward the fully open position when electric power is interrupted. If the valve actuator 104 shown in FIG. 1 is an electric valve actuator, a back-up battery may drive the valve 106 to its fail-safe position when loss of electricity occurs.

Valve actuators may be classified as linear valve actuators or rotary valve actuators. In an example, linear valve actuators open and close the actuated valve by moving the valve stem up and down. Valves that may be used with a linear valve actuator include gate valves, globe valves, and choke valves. In another example, rotary valve actuators open and close the actuated valve by rotating the valve stem. Valves that may be used with a rotary valve actuator include plug valves and ball valves. In yet another example, some valves may not require an actuator. Instead, they are opened and closed by a pilot valve and are referred to as "pilot-operated valves."

Any of the valves listed above may be used in the system 100 shown in FIG. 1. In an implementation, a gate valve has a disc-like gate which is moved up and down by a threaded valve stem. The valve actuator rotates the valve actuator stem which rotates the valve stem. The threads on the valve stem translate the rotation of the valve stem into the vertical movement of the gate. To fully open the valve, the valve stem is rotated in one direction and the gate is lifted from the bore of the valve. The valve stem is rotated in the opposite direction and the gate is lowered into the bore. When the gate re-seats, the valve is fully closed, i.e., the bore is sealed and fluid cannot flow through the valve.

In another implementation, a globe valve includes a movable disc and a stationary seat in a mostly spherical body. To open and close the valve, a valve actuator rotates the valve stem which raises or lowers the disc. To fully open the valve, the valve stem is rotated in one direction and the disc is raised until it reaches the upper limit of its travel. When the disc is in this position, fluid flows through the valve at a maximum flow rate. The valve stem is rotated in the opposite direction and the disc is lowered toward the stationary seat. When the disc contacts the stationary seat, the valve is fully closed, i.e., the disc shuts off the flow path through the valve.

In yet another implementation, a choke valve contains a "bean" which is a short flow tube having a known internal diameter. The bean is a restriction in the flow path through the valve. As the pressure drop across the bean is increased by lowering the downstream pressure, the flow rate of the fluid exiting the bean increases until the "choking" pressure drop is reached. Raising the pressure drop above the choking pressure drop does not result in an increase of the flow rate beyond the bean. The flow rate is said to be "choked."

Bean choke valves have two different configurations: in-line and angled. For example, an in-line valve is straight and has a straight flow path. The downstream portion of the valve contains the bean. In contrast, the inlet and outlet of an angled valve are at an angle to each other. The most common angle is 90°. The bean fits into the downstream portion of the valve. Fluid enters the valve, turns 90°, flows through the bean, and exits the valve.

Bean choke valves may be positive choke valves or adjustable choke valves. In the positive type of bean choke valve, fluid exits the valve at a fixed flow rate determined by the size of the bean. Positive choke valves include in-line valves having a straight flow path. Depending upon its configuration, an angled valve may be a positive choke valve. By themselves, positive choke valves cannot be controlled. They function as though they are fully open at all times. However, positive choke valves may be controlled by an upstream valve. The upstream valve opens and closes to start and stop flow to the positive choke valve. Hence, positive choke valves may be used in the system 100 shown in FIG. 1 as long as the upstream valve has an actuator that can be operated remotely.

A second type of bean choke valve may be adjustable. An adjustable bean choke valve can control the flow rate of the exiting fluid. For example, needle-and-seat choke valves are adjustable choke valves that contain a bean. They have a tapered plug attached to the valve stem. The plug moves into and out of the flow path to varying degrees to control the flow rate of the fluid exiting the valve. A needle-and-seat valve is fully open when the plug is removed from the flow path. The valve is fully closed when the plug is seated in the bean. The plug is positioned by the valve stem which may be moved by a remotely-operated actuator. As a result, a needle-and-seat valve may be used in the system 100 shown in FIG. 1.

Plug valves are used in a further implementation. A plug valve is a quarter-turn valve. Plug valves have a body that houses a cylindrical or tapered plug. The alignment of a passage in the plug determines if flow through the valve is permitted or prevented. To open and close the valve, a valve actuator rotates the valve stem which rotates the plug. To fully open the valve, the valve stem is rotated 90° in one direction. As a result, the valve moves from the fully closed position to the fully open position. In the fully open position, the passage in the plug is aligned with the inlet and outlet ports of the valve and fluid can flow through the passage. The valve actuator rotates the plug 90° in the opposite direction and the valve moves from the fully open position to the fully closed position. In the fully closed position, the passage through the plug does not align with the inlet and outlet ports of the valve and fluid cannot flow through the passage.

Ball valves are used in an additional implementation. A ball valve is also a quarter-turn valve. Ball valves function much like plug valves. However, a ball valve has a ball with a bore through it instead of a plug with a passage through it. The alignment of the bore determines if flow through the valve is allowed or not allowed. To open and close the valve, a valve actuator rotates the valve stem which rotates the ball. To fully open the valve, the valve stem is rotated 90° in one direction. As a result, the valve moves from the fully closed position to the fully open position. In the fully open position, the bore is aligned with the inlet and outlet ports of the valve and fluid can flow through the bore. The valve actuator rotates the ball 90° in the opposite direction and the valve moves from the fully open position to the fully closed position. In the fully closed position, the bore does not align with the inlet and outlet ports of the valve and fluid cannot flow through the bore.

Pilot-operated valves are used in another additional implementation. A pilot-operated valve, or main valve, is opened and closed by a pilot valve. Pilot valves house a spring connected to a diaphragm connected to a plug. There are two types of main valves that may be used with a pilot valve. They are referred to as "loading style" and "unloading style." A loading-style main valve contains a spring connected to a diaphragm connected to a plug.

Fluid enters the pilot valve and the plug is pushed downward. The plug is unseated, the pilot valve diaphragm is pulled downward, and the pilot valve spring is lengthened. Fluid passes through the open pilot valve into a loading pressure chamber located under the diaphragm of the loading-style main valve. As fluid enters the chamber, the loading pressure under the main valve diaphragm increases. The main valve diaphragm is pushed upward compressing the main valve spring and unseating the main valve plug. Fluid flows through the main valve driving the valve fully open.

When the flow of fluid stops, there is no longer any fluid flow through the pilot valve. The pressure in the pilot valve decreases and the pilot valve spring shortens. The contracting spring pulls the pilot valve diaphragm upward. As the diaphragm moves, it pulls the pilot valve plug upward causing the plug to re-seat. The upward movement of the pilot valve spring and diaphragm causes the pressure in the pilot valve to decrease even further. Fluid passes from the loading pressure chamber to the pilot valve reducing the loading pressure underneath the main valve diaphragm. The reduced loading pressure causes the main valve spring to lengthen. The elongating spring pushes the main valve diaphragm downward. As the diaphragm moves, it pushes the main valve plug downward and the plug re-seats. The main valve is fully closed. A loading-style main valve and associated pilot valve may be used in the system 100 shown in FIG. 1. However, there would be no need for the actuator 104.

An unloading-style main valve contains a spring connected to a flexible closure element. The operation of the pilot valve is the same whether the main valve is a loading-style valve or an unloading-style valve. For example, fluid enters the pilot valve and the plug is pushed downward. The plug is unseated, the pilot valve diaphragm is pulled downward, and the pilot valve spring is lengthened. Fluid flows through the open pilot valve causing a decrease in the loading pressure applied to the main valve diaphragm. As a result, the fluid's inlet pressure forces the main valve closure element to collapse and the main valve opens. The movement of the closure element compresses the main valve spring. Fluid flows through the main valve driving the valve fully open.

When the flow of fluid stops, there is a decrease in the downward force applied to the pilot valve plug. Consequently, the pilot valve spring shortens causing the pilot valve diaphragm and pilot valve plug to move upward. The plug re-seats and the pilot valve closes. Because the fluid flow has stopped, the inlet pressure decreases and the main valve spring lengthens forcing the main valve closure element to expand. The main valve closure element re-seats and the valve is fully closed. An unloading-style main valve and associated pilot valve may be used in the system 100 shown in FIG. 1. However, the pilot valve eliminates the need for the actuator 104.

Figure 2:
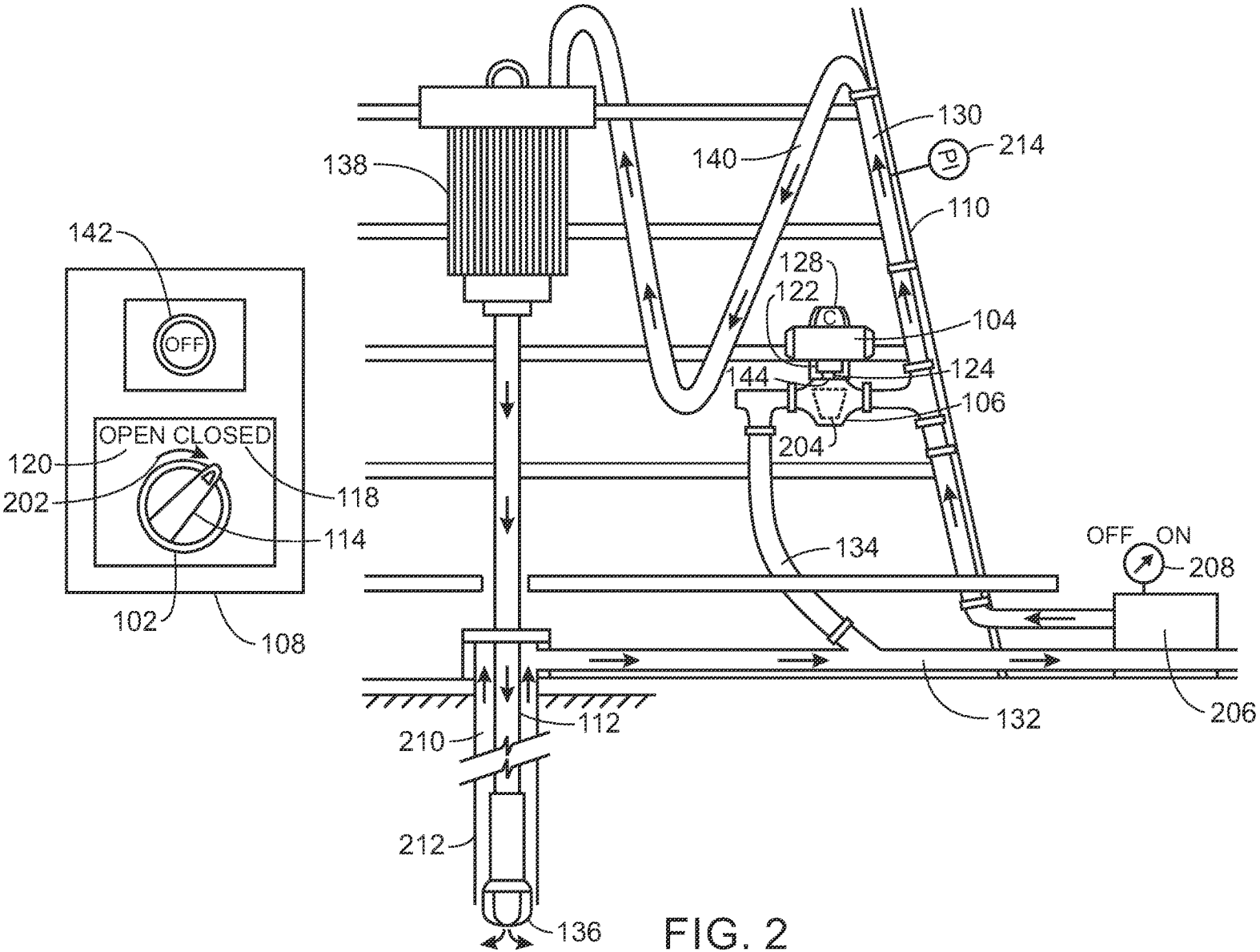
FIG. 2 is an illustration of the system shown in FIG. 1 when the valve is in a closed position.

FIG. 2 is an illustration of the system shown in FIG. 1 when the valve is in a closed position. To close the valve 106, the remote switch 102 may move from the open-valve position 120 to the closed-valve position 118. When the remote switch 102 moves, the valve actuator 104 may move from the second valve actuator position to the first valve actuator position. The valve 106 may move with the valve actuator 104. Accordingly, when the valve actuator 104 moves, the valve 106 may move from the open position to the closed position.

After a length of drillpipe has been added to the drillstring 112, the valve 106 may be closed so that drilling of the well may resume. The valve 106 may close when the handle 114 on the remote switch 102 rotates in the direction indicated by arrow 202. Accordingly, the remote switch 102 may move from the open-valve position 120 to the closed-valve position 118. The remote switch 102 may remain in the closed-valve position 118 until the handle 114 rotates in the direction indicated by arrow 116 in FIG. 1.

When the remote switch 102 is in the closed-valve position 118, the internal mechanism of the valve actuator 104 may move the valve actuator stem. Consequently, the valve 106 may move from the fully open position to the fully closed position. Movement of the valve actuator stem results in movement of the valve 106 because the valve actuator stem may be connected to the valve stem 124 by the stem connector 122. The direction of movement of the valve actuator stem, stem connector 122, valve stem 124, and valve 106 may be opposite to the direction of movement that opened the valve 106 in FIG. 1.

As in FIG. 1, the valve 106 in FIG. 2 is a plug valve which is operated by rotating it a quarter turn. The valve actuator 104 is moved by its internal mechanism which causes the valve actuator stem, stem connector 122, and valve stem 124 to rotate 90°. The result is a concomitant rotation of the valve 106. After rotating 90°, the valve 106 has moved from the fully open position to the fully closed position. In the fully closed position, the passage through the plug and the inlet and outlet ports of the plug valve are not aligned as indicated by the dashed lines 204 in FIG. 2. The valve position sensor 128 is reading "C" to confirm that the valve 106 is closed.

Further confirmation that the valve 106 is closed may be provided by the valve position indicator light 142 which is housed in the console 108 containing the remote switch 102. In the embodiment shown in FIG. 2, the valve position indicator light 142 is turned off to signify that the valve 106 is closed. In another embodiment, the valve position indicator light 142 is turned on when the valve 106 is in the closed position. In yet another embodiment, two lights are used to indicate that the valve 106 is closed. One light is labeled "Open" and the other light is labeled "Closed." The light designated "Open" is turned off and the light designated "Closed" is turned on when the valve 106 is in the closed position.

Once the valve 106 is closed, the flow of drilling fluid may be initiated by starting a drilling fluid delivery system 206. When the drilling fluid is a liquid, the drilling fluid delivery system 206 is a mud pump. When the drilling fluid is a gas, the drilling fluid delivery system 206 is a gas compressor. Confirmation that the drilling fluid delivery system 206 has been turned on and is running may be provided by the status sensor 208. The drilling fluid may be discharged from the drilling fluid delivery system 206 at a high pressure.

The drilling fluid may move up the standpipe 130. The valve 106 is closed so the drilling fluid cannot enter the flowline 132 via the bleed-off line 134. Instead, the drilling fluid may take another route to the flowline 132. In particular, the drilling fluid may continue to move up the standpipe 130. It may progress from the standpipe 130 through the rotary hose 140 to the top drive 138 and from the top drive 138 through the drillstring 112 to the drill bit 136. The drilling fluid may be expelled from the drill bit 136 and move up an annulus 210 as the drillstring 112 rotates the drill bit 136 and the rotating drill bit 136 deepens the wellbore 212. From the annulus 210, the drilling fluid may enter the flowline 132. The drilling fluid may flow up the bleed-off line 134, but will advance no further because the valve 106 is in the fully closed position. Instead, the drilling fluid may continue to flow through the flowline 132.

The drilling rig shown in FIGS. 1 and 2 utilizes a top drive to rotate the drillstring. However, use of the system for relieving drilling pressure is not limited to top drive drilling rigs. The top drive may be replaced by a Kelly and rotary table and the system may still be used prior to the addition of a length of drillpipe to the drillstring.

The drilling rig shown in FIGS. 1 and 2 is an onshore drilling rig. The system for relieving drillstring pressure may be used on an offshore drilling rig as well. In addition, it does not matter if the onshore or offshore drilling rig is drilling a wellbore that will eventually produce crude oil or natural gas. The system for relieving drillstring pressure may be used in either situation.

Furthermore, the system may relieve the pressure in the drillstring regardless of the type of drilling fluid used in the drilling of the wellbore. The drilling fluid may be a liquid drilling fluid or a gaseous drilling fluid. Liquid drilling fluids may be a water-based mud or a nonaqueous-based mud. The gaseous drilling fluids may be air, nitrogen, carbon dioxide, or natural gas.

Figure 3:
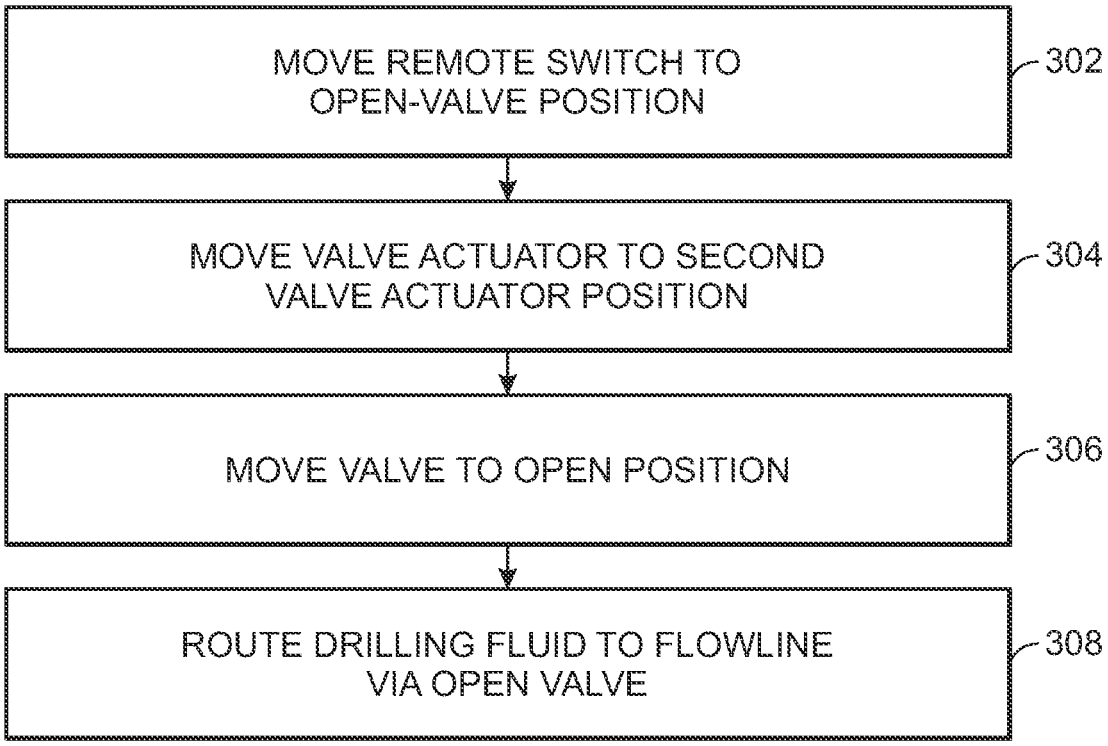
FIG. 3 is a process flow diagram of a method for relieving pressure in a drillstring using the system shown in FIG. 1.

FIG. 3 is a process flow diagram of a method for relieving pressure in a drillstring using the system shown in FIG. 1. At block 302, the remote switch 102 may move to the open-valve position 120. This may be accomplished by rotating the handle 114 on the remote switch 102 in the direction indicated by arrow 116. Accordingly, the remote switch 102 may move from the closed-valve position 118 to the open-valve position 120.

At block 304, the valve actuator 104 may move to the second valve actuator position. The positions of the valve actuator 104 may correspond to the positions of the remote switch 102. For example, the valve actuator 104 may be in the first valve actuator position when the remote switch 102 is in the closed-valve position 118 and the valve actuator 104 may be in the second valve actuator position when the remote switch 102 is in the open-valve position 120. The valve actuator 104 may move when the remote switch 102 moves. Hence, when the remote switch 102 moves from the closed-valve position 118 to the open-valve position 120, the valve actuator 104 may move from the first valve actuator position to the second valve actuator position.

At block 306, the valve 106 may move to the open position. The valve 106 may move with the valve actuator 104 because the valve actuator stem is joined to the valve stem 124 by the stem connector 122. Accordingly, when the valve actuator 104 moves from the first valve actuator position to the second valve actuator position, the valve 106 may move from the closed position to the open position.

At block 308, the drilling fluid may be routed to the flowline 132 via the open valve. Because the valve 106 is open, the pressure in the drillstring 112 may be relieved. The drilling fluid may move from the drill bit 136 through the drillstring 112 to the top drive 138 and from the top drive 138 through the rotary hose 140 to the standpipe 130. The open valve may allow the drilling fluid to progress from the standpipe 130 to the flowline 132 through the bleed-off line 134. The valve 106 may remain open as long as the drilling fluid continues to flow from the drillstring 112 to the flowline 132. The valve position indicator light 142 may be on for the entire time that the valve 106 is open.

Once the pressure in the drillstring 112 has been relieved, a section of drillpipe may be added to the drillstring 112 and drilling of the wellbore 212 may continue. However, before drilling may resume, the valve 106 has to be closed. Hence, the remote switch 102 may move from the open-valve position 120 to the closed-valve position 118. When the remote switch 102 moves, the valve actuator 104 may move from the second valve actuator position to the first valve actuator position. When the valve actuator 104 moves, the valve 106 may move from the open position to the closed position. The valve 106 may remain closed until another length of drillpipe has to be added to the drillstring 112. The valve position indicator light 142 may be off for the entire time that the valve 106 is closed.

The process flow diagram in FIG. 3 is not intended to indicate that the method 300 includes all of the blocks shown in the diagram. Furthermore, the method 300 may include any number of additional blocks not shown in the diagram depending upon the details of the specific implementation.

Figure 4:
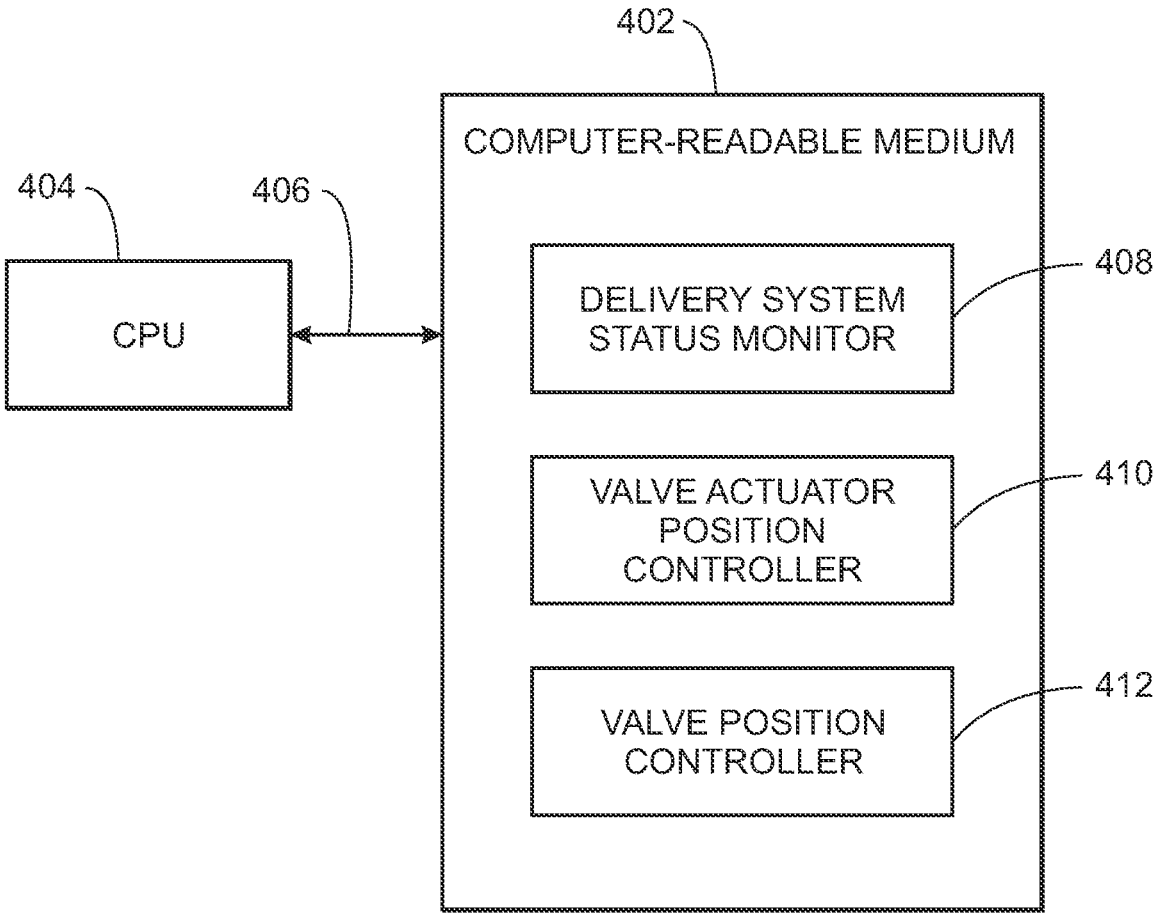
FIG. 4 is a block diagram showing a medium that contains logic for relieving pressure in a drillstring.

FIG. 4 is a block diagram showing a medium that contains logic for relieving pressure in a drillstring. The medium 402 may be a non-transitory, computer-readable medium that stores code that may be accessed by a computer processing unit (CPU) 404 via a bus 406. For example, the computer-readable medium 402 may be a volatile or non-volatile data storage device. In addition, the medium 402 may be a logic unit, such as an application specific integrated circuit (ASIC), a field programmable gate array (FPGA), or an arrangement of logic gates implemented by one or more integrated circuits.

The computer-readable medium 402 may include modules 408-412 configured to perform the techniques described herein. For example, a delivery system status monitor 408 may be configured to monitor the status of the drilling fluid delivery system 206 using the status sensor 208. A valve actuator position controller 410 may be configured to move the valve actuator 104 from the first valve actuator position to the second valve actuator position when the delivery system status monitor 408 indicates that the drilling fluid delivery system 206 is not running. A valve position controller 412 may be configured to monitor the valve position sensor 128 to confirm that the valve 106 moves from the closed position to the open position when the valve actuator 104 moves from the first valve actuator position to the second valve actuator position. Furthermore, the valve position controller 412 may be configured to maintain the valve 106 in the open position while the drilling fluid is routed from the drillstring 112 to the flowline 132 via the bleed-off line 134.

In addition, the valve actuator position controller 410 may be configured to move the valve actuator 104 from the second valve actuator position to the first valve actuator position when a pressure indicator 214 indicates that the pressure in the standpipe 130 is equal to atmospheric pressure, i.e., when the drillstring pressure has been relieved. The valve position controller 412 may also be configured to monitor the valve position sensor 128 to confirm that the valve 106 moves from the open position to the closed position when the valve actuator 104 moves from the second valve actuator position to the first valve actuator position. Furthermore, the valve position controller 412 may be configured to turn on the valve position indicator light 142 when the valve 106 moves to the open position and turn off the indicator light 142 when the valve 106 moves to the closed position. In some embodiments, the modules 408-412 may be computer code configured to direct the operations of the CPU 404.

The block diagram in FIG. 4 is not intended to indicate that the computer-readable medium 402 is to include all of the modules shown in the diagram. Furthermore, the medium 402 may include any number of additional modules not shown in the diagram depending upon the details of the specific implementation.

Thus far, the present disclosure has discussed the use of the system 100 to relieve drillstring pressure prior to the addition of a length of drillpipe to the drillstring 112. However, the system 100 may have at least one other use. It may be utilized to "surge" the drillstring 112. Surging may be necessary when a portion of the drillstring 112 becomes stuck in the wellbore 212. The stuck portion cannot be rotated or moved vertically.

When the valve 106 is opened, relief of the drillstring pressure may occur very quickly. The result may be a rapid decrease in the downhole pressure which produces pressure surges in the drillstring 112. The pressure surges may move up and down the drillstring 112 causing it to vibrate. The vibratory motion may free the stuck portion of the drillstring. The remote switch 102 may be used to open and close the valve 106 in rapid succession which increases the magnitude of the pressure surges and vibratory motion making it easier to free the stuck portion of the drillstring.

The embodiments disclosed herein may be implemented as instructions stored on a tangible, non-transitory, machine-readable medium. These instructions may be read and executed by a computing platform to perform the functions described above. A tangible, non-transitory, machine-readable medium may include any tangible, non-transitory medium for storing information in a form readable by a machine, e.g., a computer. Examples of a tangible, non-transitory, machine-readable medium may include read only memory (ROM), random access memory (RAM), magnetic disk storage media, optical storage media, flash memory devices, or the like.

Reference to "an example," "another example," "an implementation," "another implementation," or "yet another implementation" means that a particular feature, structure, or characteristic is included in at least some examples or implementations, but not necessarily in all examples or implementations, of the present techniques. The various occurrences of "an example" or "an implementation" are not necessarily referring to the same example or implementation.

Not all components, features, structures, characteristics, etc. described and illustrated herein need be included in a particular embodiment or embodiments. For example, if the specification states a component, feature, structure, or characteristic "may" be included, that particular component, feature, structure, or characteristic is not required to be included. If the specification refers to "a" or "an" element, that does not mean there is only one of the element. If the specification refers to an "additional" element, there may be more than one of the additional element.

Some embodiments have been described by referring to particular examples or implementations. However, other examples and implementations are possible. The examples and implementations of the present techniques are not limited to those disclosed herein. Additionally, the sequence of the functions and the arrangement of the features described above or illustrated in the drawings need not be sequenced or arranged in the particular way described or illustrated. Other sequences or arrangements are possible.

Elements shown in the drawings may have the same reference number to suggest that the elements are similar. Alternatively, elements shown in the drawings may have different reference numbers to suggest that the elements are different. However, an element may be flexible enough to be present in some or all of the examples or implementations and work with some or all of the systems described above or shown in the drawings. Various elements described herein or depicted in the drawings may be designated as a first element, second element, etc. It is arbitrary which element is referred to as the first element, which element is referred to as the second element, and so on.

Details of an aforementioned example or implementation may apply to one or more embodiments. For example, all optional features of the system for relieving drillstring pressure may be implemented in either the method or computer-readable medium described above. Furthermore, a process flow diagram has been used herein to describe an embodiment. However, the present techniques are not limited to that diagram or to the corresponding description. For example, the process exemplified in the diagram need not progress through each box or in exactly the same order as illustrated.

The present techniques are not restricted to the particular details described herein. Those skilled in the art having the benefit of this disclosure will appreciate that many other variations of the foregoing descriptions and accompanying drawings are possible and remain within the scope of the present techniques. Accordingly, the scope of the present techniques is defined by the following claims and any amendments thereto.

What is claimed is:

1. A system for relieving pressure in a drillstring on a drilling rig, comprising:

a valve actuator to move from a first valve actuator position to a second valve actuator position when a delivery system status sensor indicates that a drilling fluid delivery system is not running and from the second valve actuator position to the first valve actuator position when a pressure indicator indicates that the pressure in a standpipe on the drilling rig equals atmospheric pressure;

a valve position sensor to confirm that a valve stem rotates from a first valve stem position to a second valve stem position when the valve actuator moves from the first valve actuator position to the second valve actuator position and from the second valve stem position to the first valve stem position when the valve actuator moves from the second valve actuator position to the first valve actuator position;

a valve closure element to move from a closed position to an open position when the valve stem rotates from the first valve stem position to the second valve stem position and from the open position to the closed position when the valve stem rotates from the second valve stem position to the first valve stem position;

a valve position indicator light to turn on when the valve closure element moves to the open position and turn off when the valve closure element moves to the closed position; and a bleed-off line to reduce the pressure in the standpipe by routing a drilling fluid from the drillstring to a flowline when the valve closure element is in the open position.

2. The system of claim 1, wherein the drilling rig is an onshore drilling rig or an offshore drilling rig.

3. The system of claim 1, wherein the drilling fluid is a liquid drilling fluid or a gaseous drilling fluid.

4. The system of claim 3, wherein the liquid drilling fluid is a water-based mud or a nonaqueous-based mud and the gaseous drilling fluid is air, nitrogen, carbon dioxide, or natural gas.

5. The system of claim 1, wherein the valve actuator is a pneumatic valve actuator, a hydraulic valve actuator, or an electric valve actuator.

6. The system of claim 1, wherein a valve is located in a section of pipe laterally connected to the standpipe and the valve comprises the valve stem and the valve closure element.

7. The system of claim 1, wherein the valve closure element is a plug, a ball, a disc-like gate, or a movable disc.

8. The system of claim 1, wherein the drilling fluid delivery system is a mud pump or a gas compressor.

9. A method for relieving pressure in a drillstring on a drilling rig, comprising:

moving a valve actuator from a first valve actuator position to a second valve actuator position when a delivery system status sensor indicates that a drilling fluid delivery system is not running;

monitoring a valve position sensor to confirm that a valve stem rotates from a first valve stem position to a second valve stem position when the valve actuator moves from the first valve actuator position to the second valve actuator position;

moving a valve closure element from a closed position to an open position when the valve stem rotates from the first valve stem position to the second valve stem position;

turning on a valve position indicator light when the valve closure element moves to the open position;

maintaining the valve closure element in the open position to route a drilling fluid from the drillstring to a flowline via a bleed-off line;

moving the valve actuator from the second valve actuator position to the first valve actuator position when a pressure indicator indicates that the pressure in a standpipe on the drilling rig equals atmospheric pressure;

monitoring the valve position sensor to confirm that the valve stem rotates from the second valve stem position to the first valve stem position when the valve actuator moves from the second valve actuator position to the first valve actuator position;

moving the valve closure element from the open position to the closed position when the valve stem rotates from the second valve stem position to the first valve stem position; and turning off the valve position indicator light when the valve closure element moves to the closed position.

10. The method of claim 9, wherein the drilling rig is an onshore drilling rig or an offshore drilling rig.

11. The method of claim 9, wherein the drilling fluid is a liquid drilling fluid or a gaseous drilling fluid.

12. The method of claim 11, wherein the liquid drilling fluid is a water-based mud or a nonaqueous-based mud and the gaseous drilling fluid is air, nitrogen, carbon dioxide, or natural gas.

13. The method of claim 9, wherein the valve actuator is a pneumatic valve actuator, a hydraulic valve actuator, or an electric valve actuator.

14. The method of claim 9, wherein a valve is located in a section of pipe laterally connected to the standpipe and the valve comprises the valve stem and the valve closure element.

15. The method of claim 9, wherein the valve closure element is a plug, a ball, a disc-like gate, or a movable disc.

16. The method of claim 9, wherein the drilling fluid delivery system is a mud pump or a gas compressor.

17. At least one non-transitory, computer-readable medium, comprising instructions to direct a processor to:

move a valve actuator from a first valve actuator position to a second valve actuator position when a delivery system status sensor indicates that a drilling fluid delivery system is not running;

monitor a valve position sensor to confirm that a valve stem rotates from a first valve stem position to a second valve stem position when the valve actuator moves from the first valve actuator position to the second valve actuator position;

move a valve closure element from a closed position to an open position when the valve stem rotates from the first valve stem position to the second valve stem position;

turn on a valve position indicator light when the valve closure element moves to the open position;

maintain the valve closure element in the open position to route a drilling fluid from a drillstring to a flowline via a bleed-off line;

move the valve actuator from the second valve actuator position to the first valve actuator position when a pressure indicator indicates that a pressure in a standpipe on a drilling rig equals atmospheric pressure;

monitor the valve position sensor to confirm that the valve stem rotates from the second valve stem position to the first valve stem position when the valve actuator moves from the second valve actuator position to the first valve actuator position;

move the valve closure element from the open position to the closed position when the valve stem rotates from the second valve stem position to the first valve stem position; and turn off the valve position indicator light when the valve closure element moves to the closed position.

18. The at least one non-transitory, computer-readable medium of claim 17, wherein the drilling rig is an onshore drilling rig or an offshore drilling rig.

19. The at least one non-transitory, computer-readable medium of claim 17, wherein the drilling fluid is a liquid drilling fluid or a gaseous drilling fluid.

20. The at least one non-transitory, computer-readable medium of claim 17, wherein the valve actuator is a pneumatic valve actuator, a hydraulic valve actuator, or an electric valve actuator.

* * * * *